US010227195B2

(12) United States Patent
Page et al.

(10) Patent No.: US 10,227,195 B2
(45) Date of Patent: Mar. 12, 2019

(54) STAND FOR SELF CONTAINED CARTRIDGE AND METHOD FOR MANUALLY DISPENSING AN EXPANDABLE CUSHIONING WRAP

(71) Applicant: Ranpak Corp., Concord Township, OH (US)

(72) Inventors: Brandon Page, Durham, NC (US); Marcelo Passos, Morrisville, NC (US)

(73) Assignee: RANPAK CORP., Painesville, OH (US)

( * ) Notice: Subject to any disclaimer, the term of this patent is extended or adjusted under 35 U.S.C. 154(b) by 219 days.

(21) Appl. No.: 14/897,526

(22) PCT Filed: Jun. 12, 2014

(86) PCT No.: PCT/US2014/042175
§ 371 (c)(1),
(2) Date: Dec. 10, 2015

(87) PCT Pub. No.: WO2014/201284
PCT Pub. Date: Dec. 18, 2014

(65) Prior Publication Data

US 2016/0130104 A1 May 12, 2016

Related U.S. Application Data

(60) Provisional application No. 61/834,041, filed on Jun. 12, 2013.

(51) Int. Cl.
*B65H 23/08* (2006.01)
*B65H 16/00* (2006.01)
(Continued)

(52) U.S. Cl.
CPC ..... *B65H 16/005* (2013.01); *B65H 16/021* (2013.01); *B65H 16/06* (2013.01);
(Continued)

(58) Field of Classification Search
CPC .... B65H 16/005; B65H 16/06; B65H 16/021; B65H 75/185; B65H 23/08
See application file for complete search history.

(56) References Cited

U.S. PATENT DOCUMENTS 2,144,757 A * 1/1939 Gilling ..... B65H 35/0006 242/596.1
4,179,077 A 12/1979 Morishita
(Continued)

FOREIGN PATENT DOCUMENTS

DE 40 26 895 A1 2/1992
DE 40 26 895 A1 2/1997
(Continued)

OTHER PUBLICATIONS

International Preliminary Report on Patentability for corresponding patent application No. PCT/US2014/042175 dated Dec. 23, 2015.
(Continued)

*Primary Examiner* — Sang K Kim
(74) *Attorney, Agent, or Firm* — Renner, Otto, Boisselle & Sklar, LLP

(57) ABSTRACT

An unpowered, manually operable apparatus for dispensing cushioning wrap material drawn concurrently from a roll of separator material and a self-contained cartridge that includes a roll of expandable sheet material. The rolls are supported on a stand for rotation about respective parallel, spaced-apart axes. In addition to the roll, the cartridge includes a tensioning assembly and support panels that abut respective ends of the roll. The tensioning assembly and the support panels cooperate with the stand to control rotational resistance of the roll. The rotational resistance causes the expandable sheet material to expand in length and thickness as it is manually pulled from the stand with the separator material, and support surfaces on the stand hold the cartridge and the separator roll in position. When the cartridge con-
(Continued)

taining the expandable sheet material is depleted, the cartridge is readily removed and replaced.

9 Claims, 9 Drawing Sheets

(51) Int. Cl.
*B65H 75/18* (2006.01)
*B65H 16/02* (2006.01)
*B65H 16/06* (2006.01)

(52) U.S. Cl.
CPC ..... *B65H 23/08* (2013.01); *B65H 75/185* (2013.01); *B65H 2301/41346* (2013.01); *B65H 2301/41369* (2013.01); *B65H 2403/941* (2013.01); *B65H 2701/1849* (2013.01)

(56) References Cited

U.S. PATENT DOCUMENTS 4,316,564 A 2/1982 Felicetti
5,667,871 A * 9/1997 Goodrich ..... B31C 5/00 206/521
7,222,817 B2 * 5/2007 Stringer ..... B65D 83/0805 242/588.3
7,568,653 B2 * 8/2009 Zeiron ..... A47K 10/38 242/596.7
8,500,058 B2 * 8/2013 Lan ..... B41J 15/042 242/578
8,845,089 B2 * 9/2014 Akatsu ..... B41J 11/00 242/596
8,882,374 B2 * 11/2014 Colonel ..... B41J 3/4075 242/596
2004/0040429 A1 3/2004 Nichols et al.

FOREIGN PATENT DOCUMENTS

DE 20 2008 008824 U1 10/2008
EP 1 228 996 A1 8/2002
WO 2011/068447 A1 6/2011
WO 2012/027346 A2 2/2012
WO 2012/027346 A2 3/2012

OTHER PUBLICATIONS

International Search Report for PCT/US2014/042175 dated Mar. 30, 2015.

* cited by examiner

STAND FOR SELF CONTAINED CARTRIDGE AND METHOD FOR MANUALLY DISPENSING AN EXPANDABLE CUSHIONING WRAP

This application is a national phase of International Application No. PCT/US2014/042175 filed Jun. 12, 2014, and published in the English language on Dec. 18, 2014, and claims benefit of U.S. Provisional Patent Application Ser. No. 61/834,041, filed Jun. 12, 2013.

FIELD OF THE INVENTION

This invention related generally to a packaging system and method, and more particularly to a packaging system and method for dispensing a cushioning wrap material.

BACKGROUND OF THE INVENTION

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. The dunnage material thus prevents or minimizes movement of the articles that might be damaged during the shipping process. Some commonly used dunnage materials include plastic airbags and converted paper dunnage material.

Some void-filling dunnage material also is suitable for use as a cushioning wrap that can be used to separate fragile articles or to surround fragile articles in a protective wrap. An expandable, slit sheet packing material may provide one type of cushioning wrap. The sheet material, such as paper, has a plurality of rows of slits across a width of the sheet and when the sheet is pulled in a longitudinal direction transverse the slits, the sheet reduces in width and increases in length and thickness. This stretching and increase in thickness of the slit sheet paper packing material is referred to as expansion. The thickness of the slit sheet paper packing material can increase by an order of magnitude, or more, relative to its original thickness, when stretched. This increased thickness allows the expanded material to serve as a protective cushioning wrap material for articles. Slit sheet paper packing material, and the manufacturing thereof, are described in greater detail in U.S. Pat. Nos. 5,667,871 and 5,688,578. The cushioning wrap material formed with expanded slit sheet packing material may include a layer of sheet material, such as a lightweight tissue paper, that acts as a separator sheet between layers of the expanded material. The separator sheet prevents openings in the expanded paper from nesting in a flatter configuration or becoming interlocked.

SUMMARY OF THE INVENTION

The present invention provides an unpowered, manually operable apparatus for dispensing cushioning wrap material drawn concurrently from a roll of separator material and a self-contained cartridge that includes a roll of expandable sheet material in such a manner that the expandable sheet material expands as it is drawn from the roll. The rolls are supported on a stand for rotation about respective parallel, spaced-apart axes. And when the cartridge containing the expandable sheet material is depleted, the cartridge is readily removed and replaced. In addition to the roll, the cartridge includes a tensioning assembly and end panels that abut respective ends of the roll. The tensioning assembly and the end panels cooperate with the stand to control rotational resistance of the roll. The rotational resistance causes the expandable sheet material to expand in length and thickness as it is pulled from the stand with the separator material by a user, and support surfaces on the stand hold the cartridge and the separator roll in position. The present invention thus provides an improved method for manually dispensing an expandable cushioning wrap using a self-contained cartridge and a stand adapted to receive and support the cartridge and a roll of separator material.

More particularly, the present invention provides a self-contained material supply cartridge that includes (a) a roll of expandable sheet material, and (b) a pair of laterally-spaced end panels between which the roll is mounted for rotation relative to the end panels about an axis of rotation. The end panels have lower edge portions that project radially beyond the radius of the roll on each side of a plane that includes the axis of rotation. And the end panels are held in abutment with respective ends of the roll by a connector that extends between the end panels. The connector has a collar that bears directly against the side of the end panel opposite the roll, and the end panel directly engages the end of the roll.

The connector may include a tensioning assembly, and may be adjustable to vary pressure applied to the ends of the roll by the end panels. The roll may include a hollow core around which the expandable sheet material is wound and through which the connector is received. The connector may include end caps received in respective ends of the hollow core and a flexible cord that connects the end caps, whereby rotating one end cap relative to the other twists and shortens the flexible cord.

The roll may be made of paper and the end panels may be cardboard.

The present invention also provides a stand for dispensing an expanded sheet material from a self-contained material supply cartridge having a roll of expandable sheet material that can be drawn from the roll in a downstream direction relative to the stand. The stand includes a base support member having first and second upwardly-opening slots laterally-spaced apart along a first axis and adapted to receive lower edge portions of support panels of a material supply cartridge, and third and fourth upwardly-opening slots laterally-spaced apart along a second axis spaced from and parallel to the first axis and adapted to receive an axle for a roll of separating sheet material. The slots each have a transversely-extending surface on at least a downstream side of the slot to retain respective rolls as expandable sheet material and separating sheet material are concurrently drawn from the rolls.

The base support member may be generally planar and the slots may be formed by first and second brackets mounted to the base support member. Each bracket may have an L-shape surface on a downstream side with a leg extending inwardly toward the opposing bracket. Each bracket may have an L-shape surface on an upstream side opposite the downstream side with a leg extending inwardly toward the opposing bracket. The upstream and downstream L-shape surfaces may form respective portions of a continuous U-shape surface.

The third and fourth upwardly-opening slots may be defined by respective brackets with upwardly-opening slots.

The stand may be provided in combination with a self-contained material supply cartridge that includes a roll of expandable sheet material, and a pair of laterally-spaced end panels to which the roll is mounted between the end panels for rotation relative to the end panels about an axis of rotation. The end panels may have lower edge portions that project radially beyond the radius of the roll on each side of a plane that includes the axis of rotation. And the end panels may be held in abutment with respective ends of the roll by a connector that extends between the end panels. The connector may have a collar that bears directly against the side of the end panel opposite the roll, and the end panels may directly engage respective ends of the roll.

The stand may be provided in combination with a roll of separating sheet material made of paper mounted on an axle for receipt in the third and fourth slots.

The present invention also provides a method of dispensing cushioning wrap material from an unpowered apparatus. The method includes the step of concurrently manually pulling interleaf material from a first roll rotatably secured to a frame and expandable sheet material in an unexpanded form from a replaceable cartridge secured to the frame while maintaining rotational resistance of the second roll such that the expandable sheet material expands to an expanded form in thickness and in length, and such that the interleaf material and the expandable sheet material in expanded form are in abutting face-to-face contact.

The method may include the step of adjusting the rotational resistance of the roll of expandable sheet material via a tensioning assembly operably associated with the roll such the expandable sheet material in its expanded form has a desired width.

The present invention may further provide an unpowered, manually operable apparatus for dispensing cushioning wrap material that includes a frame, a roll of interleaf material rotatably secured to the frame, and a replaceable cartridge.

The cartridge may include a roll of expandable sheet material in an unexpanded form and a tensioning assembly.

The tensioning assembly may be part of the replaceable cartridge, may be operably associated with the roll of expandable sheet material that may include first and second core plugs, and first and second support members and a cord extending between the first and second core plugs, whereby rotating the first and second core plugs relative to one another twists the cord. Twisting the cord may be used to control rotational resistance between the first and second support members and the roll, wherein the rotational resistance causes the expandable sheet material to expand in length and thickness as it is pulled from the roll by a user.

The tensioning assembly may have an adjustment mechanism to control rotational resistance of the roll of expandable sheet material.

In some embodiments of the present invention, the frame includes a pair of front opposing brackets that extend upwardly from the frame. Each front bracket has an open ended, elongated slot formed therein. The roll of interleaf material includes a hollow, axially-extending core and is rotatably secured to the frame via an elongated rod extending through the core. The elongated rod includes opposite end portions, and each end portion is received within a respective slot. The open end of each front bracket slot is configured to inhibit unintentional removal of a respective rod end portion from the bracket slot.

In some embodiments of the present invention, the elongated rod includes a first pair of spaced-apart stops that limit axial movement of the rod relative to the front brackets. The elongated rod also may include a second pair of spaced-apart stops located between the first pair of stops, and that are configured to limit axial movement of the roll of interleaf material supported by the rod.

In some embodiments of the present invention, the frame includes a pair of opposing rear brackets that extend upwardly from the frame in adjacent, spaced-apart relationship with the pair of opposing front brackets. The brackets each form a receiving slot. The replaceable cartridge of expandable material is received in the slots formed by the rear brackets.

In some embodiments the replaceable cartridge includes a roll of expandable sheet material wound on a hollow, axially-extending core, first and second support members bounding axial ends of the roll, and first and second core plugs and a cord connecting the core plugs that form a tension assembly. The core plugs connect the support members with respective ends of the roll. The first and second support members each may have an opening configured for receipt of the core plugs. The first support member may be located proximate to a first end of the roll of expandable sheet material, and the second support member may be located proximate to an opposing second end of the roll of expandable material.

The first core plug may include opposite first and second end portions and a radially outwardly-directed flange adjacent the first end portion. First and second passageways may be formed through the first core plug from the first end portion to the second end portion. The second end portion of the first core plug may extend through the opening in the first support member and into one end of the hollow core such that the first support member is positioned between a first end of the roll of expandable sheet material and the flange of the first core plug.

The second core plug may include opposite first and second end portions and a radially outwardly-directed flange adjacent the first end portion of the second core plug. A third passageway may be formed through the second core plug. The end portion of the second core plug may extend through the opening in the second support member and into an opposite end of the hollow core.

The cord may extend though the hollow core, and through the first, second, and third passageways to form a loop. The loop is configured to twist and cause the first support member to exert a compressive force on the first end of the roll of expandable sheet material in response to user rotation of the second core plug.

Typically, the width of the roll of interleaf material has a width less than a width of the expandable sheet material in an expanded form such that opposite, longitudinally-extending side edge portions of the expanded sheet material are exposed. For example, in some embodiments of the present invention, the width of the roll of interleaf material is between about 10%-50% less than the width of the roll of expandable sheet material. However, in some embodiments, the layer of interleaf material may have a width that is substantially the same as a width of the layer of expanded sheet material.

The expandable sheet material may include a slit pattern which forms an array of openings (e.g., hexagonal openings) when the expandable sheet material is in an expanded form.

The expandable sheet material and the interleaf material may include non-woven fibrous sheet materials. For example, the expanded sheet material may be die-cut slit kraft paper, and the interleaf material may be tissue paper.

A method of dispensing cushioning wrap material from an unpowered, manually operable apparatus may include concurrently manually pulling both interleaf material from a first roll rotatably secured to a frame and expandable sheet material in an unexpanded form from a second roll in a replaceable cartridge secured to the frame while maintaining rotational resistance of the second roll such that the expandable sheet material expands to an expanded form in thickness and in length, and such that the interleaf material and the expandable sheet material in expanded form are in abutting face-to-face contact. The rotational resistance of the second roll in the replaceable cartridge of expandable sheet material can be adjusted via a tensioning assembly that is operably associated with the second roll and the frame such the expandable sheet material in its expanded form has a desired width. For example, the rotational resistance is adjusted such that the width of the interleaf material is between about 10%-50% less than a width of the expandable sheet material in its expanded form. The layer of interleaf material may have a width that is substantially the same as a width of the layer of expanded sheet material.

Further features of the invention will become apparent from the following detailed description when considered in conjunction with the drawings.

DETAILED DESCRIPTION

Figure 1:
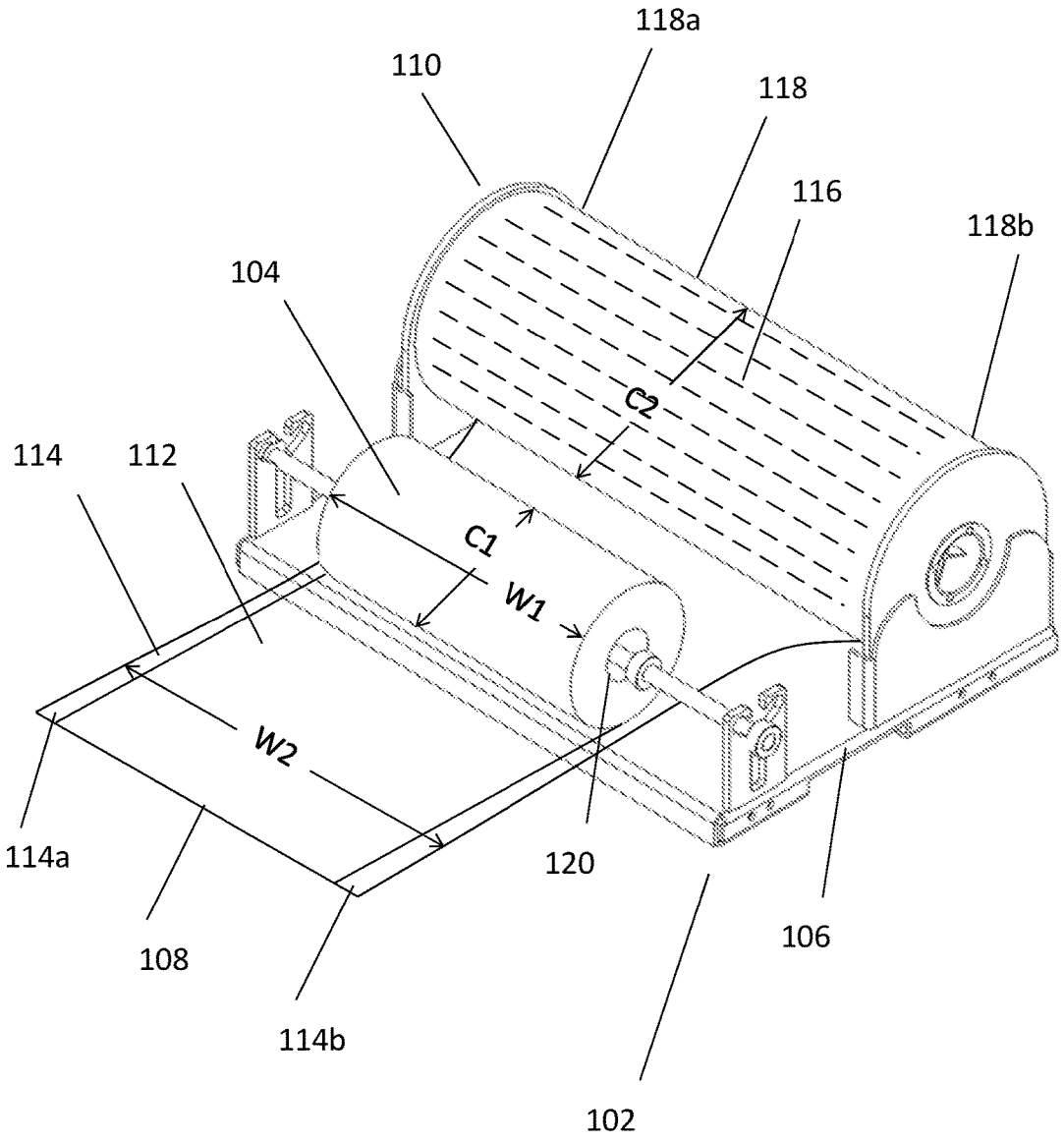
FIG. 1 is a front perspective view of an apparatus for dispensing cushioning wrap material from a roll of interleaf material and a replaceable cartridge with a roll of expandable sheet material.
Figure 2:
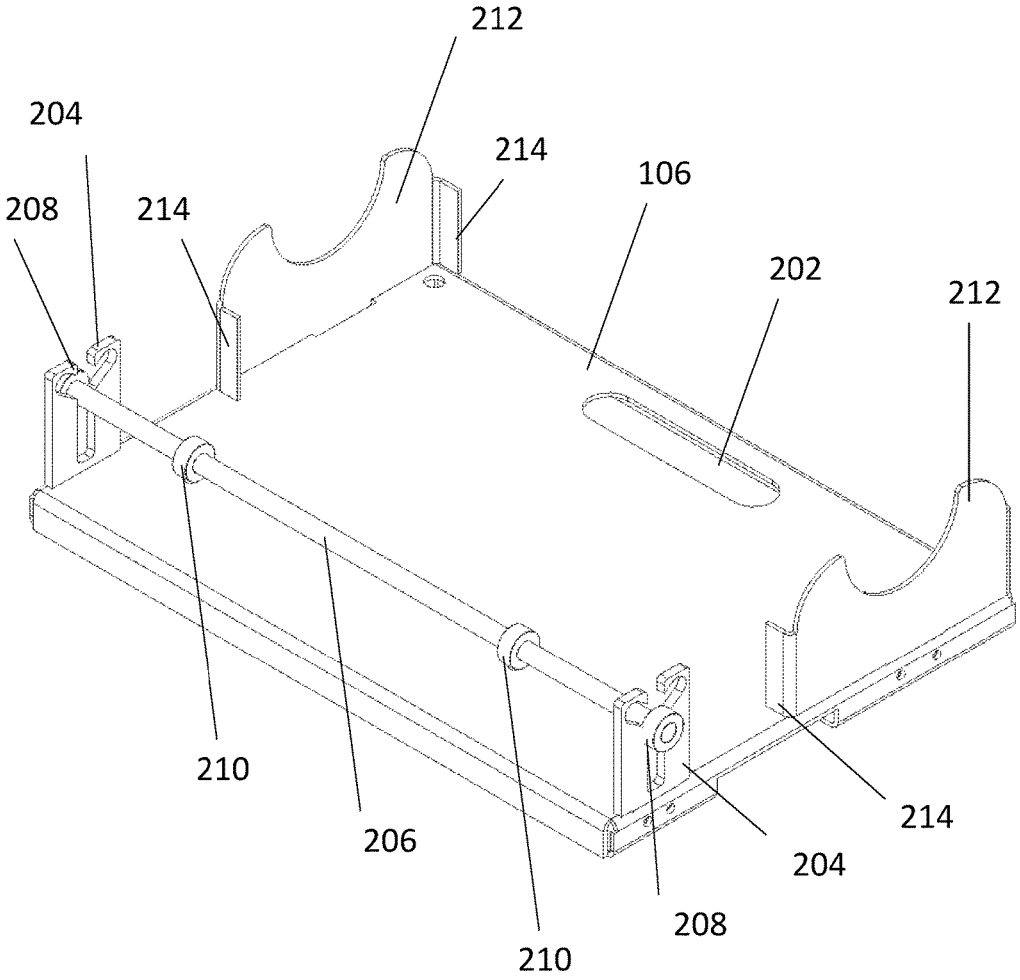
FIG. 2 is a front perspective view of the apparatus of FIG. 1 with the roll of interleaf material and the replaceable cartridge of expandable sheet material omitted.
Figure 3:
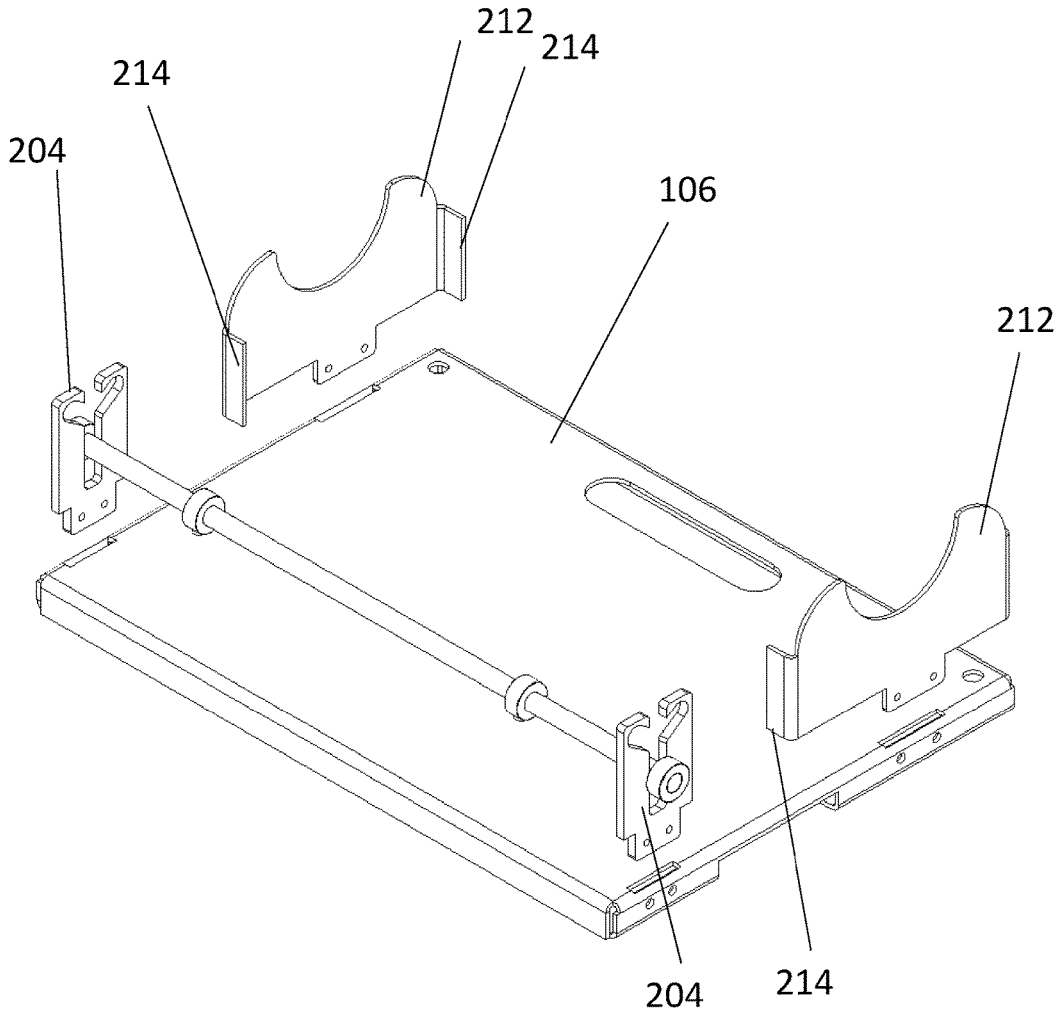
FIG. 3 is an exploded perspective view of the dispensing apparatus of FIG. 2.

Unless otherwise defined, all terms (including technical and scientific terms) used herein have the same meaning as commonly understood by one of ordinary skill in the art at the time of the invention.

The term "about," when used with respect to a value or number, means that the value or number can vary by +/−twenty percent (20%).

The term "longitudinal centerline" refers to the centerline of a layer of material that divides the lateral width (i.e., from side edge to side edge) of the layer in two equal halves.

The term "unpowered" means that the apparatus dispenses cushioning wrap material manually and without the aid of electrical or other sources of power.

The present invention provides an unpowered, manually operable apparatus for dispensing cushioning wrap material drawn concurrently from a roll of separator material and a self-contained cartridge that includes a roll of expandable sheet material in such a manner that the expandable sheet material expands as it is drawn from the roll. An exemplary apparatus 102 for dispensing cushioning wrap material 108 is shown in FIGS. 1-6. The apparatus 102 (which also may be referred to as a stand) includes a base support member (frame 106) and respective brackets that define slots for receipt of a roll 104 of interleaf separator material 112 rotatably secured to the frame 106, and a cartridge 110 containing a roll 118 of expandable sheet material 116 in an unexpanded form secured to the frame 106 adjacent the roll 104 of interleaf material 112. When dispensed, by pulling the expandable sheet material 116 and the interleaf material 112 at the same time in a downstream direction (a longitudinal direction of the sheet material as it is drawn from the cartridge 110 with the expandable sheet material 116 toward the roll 104 of interleaf material 112), the expandable sheet material 116 in an expanded form 114 and the interleaf material 112 combine to form the cushioning wrap material 108. The expandable sheet material 116 includes a slit pattern which forms an array of openings (e.g., hexagonal openings) when the expandable sheet material is stretched to an expanded form.

An exemplary expanded sheet material 114 and an exemplary interleaf material 112 are non-woven fibrous sheet materials, such as paper. For example, the expanded sheet material 114 may can be a die-cut slit kraft paper, such as described in U.S. Pat. Nos. 5,667,871 and 5,688,578, and the interleaf material can be tissue paper.

Typically, the width W1 of the roll 104 of interleaf material 112 is less than a width W2 of the expanded sheet material 114 in either an unexpanded or an expanded form, such that opposite, longitudinally-extending side edge portions of the expandable sheet material 116 are exposed. For example, the width W1 of the roll 104 of interleaf material 112 may be between about 10% to 50% less than the width W2 of the expandable sheet material 116 in an expanded form 114. When an article is wrapped in the cushioning wrap material 108, openings in the exposed edge portions 114*a*, 114*b* of the expanded sheet material 114 can interlock with each other to help maintain the cushioning wrap material 108 in a wrapped state.

The illustrated frame 106 has a generally planar and rectangular shape, but the frame 106 may have various shapes and configurations. The illustrated frame 106 also includes a slot 202 formed therein to facilitate user manipulation of the frame, including carrying of the frame, etc. pair of laterally-spaced, opposing brackets 204 extend upwardly from the frame 106 adjacent a front end of the frame 106. The front end of the frame 106 also can be referred to as the downstream end because the expandable sheet material 116 is drawn from the cartridge 110 in a downstream direction over the front end of the frame 106. The rear end of the frame 106 is opposite the front end and may be referred to as an upstream end of the frame, the upstream direction being opposite the downstream direction.

Each bracket 204 includes opposite end portions with one end portion configured to be inserted within a respective slot formed in the frame 106. One end portion of each bracket 204 also includes a pair of threaded openings formed therein. When the bracket is inserted within the slot, the threaded openings align with corresponding openings in the respective frame side portions. Threaded fasteners, such as bolts or screws, threadingly engage the aligned threaded openings to secure each bracket 204 to the frame 106. Other ways of attaching the brackets 204 to the frame 106 may be used, however, including, but not limited to, a press fit, welding, brazing, adhesives, and the like. Alternatively, the brackets 204 and the frame 106 may be formed as a single, continuous piece.

Each bracket 204 includes an upwardly-extending elongated slot that defines at least a downstream transversely-extending surface for holding an axle formed by a rod 206 that supports the interleaf material 112 as interleaf material is drawn from the roll 112 in the downstream direction. As will be described below, during use of the apparatus 102, each slot is configured to inhibit unintentional disengagement or removal from the frame 106 of the rod 206 that supports the roll 104 of interleaf material 112. Other ways of preventing unintentional disengagement or removal from the frame 106 of the rod 206 may be employed other than the illustrated slot, such as a locking mechanism placed over the open bracket slot, etc.

The roll 104 of interleaf material 112 includes a hollow, axially-extending core 120 and is supported on the frame 106 by an elongated rod 206 that extends through the hollow core 120. The rod 206 includes opposite end portions. The roll 104 of interleaf material 112 is attached to the frame 106 by lowering each end portion of the rod 206 through the open end of a respective bracket slot 204. The rod 206 includes a first pair of spaced-apart stops 208 that limit axial movement of the rod 206 relative to the brackets 204. Each stop 208 in the illustrated embodiment is generally cylindrical and has a hollow, axially-extending core through which the rod 206 can be inserted. Each stop 208 can be secured to the rod 206 via a set screw that threadingly engages a threaded passage in the stop 208, as would be understood by one skilled in the art. Accordingly, the position of each stop 208 on the rod 206 may be adjusted by the user as needed.

The illustrated rod 206 also includes a second pair of spaced-apart stops 210 that are located between the first pair of stops 208. The second pair of stops 210 are configured to limit axial movement of the roll 104 of interleaf material 112 supported by the rod 206. Similar to stops 208, each stop 210 is generally cylindrical and has a hollow, axially-extending core through which the rod 206 can be inserted. Each stop 210 is secured to the rod 206 via a set screw that threadingly engages a threaded passage in the stop 210, as would be understood by one skilled in the art. Accordingly, the position of each stop 210 on the rod 206 also may be adjusted by the user as needed. Typically, the stops 210 are positioned on the rod 206 such that the longitudinal centerline C1 of the roll 104 is substantially aligned with a longitudinal centerline C2 of the roll 118.

During use of the apparatus 102, when a user pulls the interleaf material 112 from the roll 104, the rod 206 may have the tendency to rise upwardly in the slots of the brackets 204. The configuration of each slot, specifically the slot portions, at the top are configured to trap a respective end portion, of the rod 206, thereby inhibiting unintentional removal of the rod 206 and roll 104 of interleaf material 112 from the frame 106.

A second pair of brackets 212 extend upwardly from the frame 106 adjacent the frame rear end portion, toward an upstream end of the frame 106 opposite the downstream or front end. Each bracket 212 may include opposite end portions with one end portion configured to be inserted within a respective slot formed in the frame 106. The end portion of each bracket 212 to be received by frame 106 also includes a pair of threaded openings. When the bracket end portion is inserted within the slot, the threaded openings align with corresponding openings in the respective frame side portions. Threaded fasteners, such as bolts or screws, threadingly engage the aligned openings, to secure each bracket 212 to the frame 106. Other ways of attaching the bracket 212 to the frame 106 may be used, including, but not limited to, a press fit, welding, brazing, adhesives, and the like. Alternatively, the brackets 212 and the frame 106 may be formed as a single, continuous piece.

Each bracket 212 also includes a pair of longitudinally-spaced tabs 214 configured to receive a cartridge of expandable sheet material 110. The tabs 214 define transversely, inwardly-extending surfaces, and the brackets 212 form upstream and downstream L-shape surfaces with legs that extend inwardly toward an opposing bracket 212 and the tabs 214 cooperate to form a continuous U-shape surface in the bracket 212. These surfaces also define a slot for close receipt of the cartridge 110. The cartridge-supporting brackets 212 are arranged on the frame 106 relative to the interleaf-supporting brackets 204 such that the axial dimensions of the rolls 104 and 118 are spaced apart and are substantially parallel when the rolls 104 and 118 are mounted to the frame 106.

The frame 106 and the brackets 212 and 204 may be formed from various materials suitable to provide a substantially rigid base for supporting the roll 104 of interleaf material 112 and the replaceable cartridge 110 of expandable sheet material 116. Exemplary materials include, but are not limited to, iron, steel, carbon steel, alloy steel, stainless steel, aluminum, plastic and/or any combination and/or alloys thereof. Similarly, the rod 206 may be formed from various materials suitable to provide a substantially rigid member about which the roll 104 of interleaf material 112 extends for rotation. Exemplary materials include, but are not limited to, iron, steel, carbon steel, alloy steel, stainless steel, aluminum, plastic and/or any combination and/or alloys thereof. Moreover, the rod 206 may be hollow or solid.

The invention is not limited to the illustrated arrangement of the brackets 204 and 212 relative to the base, other configurations and orientations are possible within the scope of the present invention.

Referring now to FIGS. 4-9, a replaceable cartridge of expandable sheet material in unexpanded form 110 is illustrated. The illustrated replaceable cartridge 110 includes a connector extending through the hollow core around which the expandable sheet material 116 is wound to form the roll 118. The connector includes a tensioning assembly 602 that is operably associated with the roll 118 of expandable sheet material 116 to control rotational resistance of the roll 118 as a user pulls the expandable material 116 from the cartridge 110. This rotational resistance causes the expandable material to expand in thickness and length, as will be described below.

Figure 4:
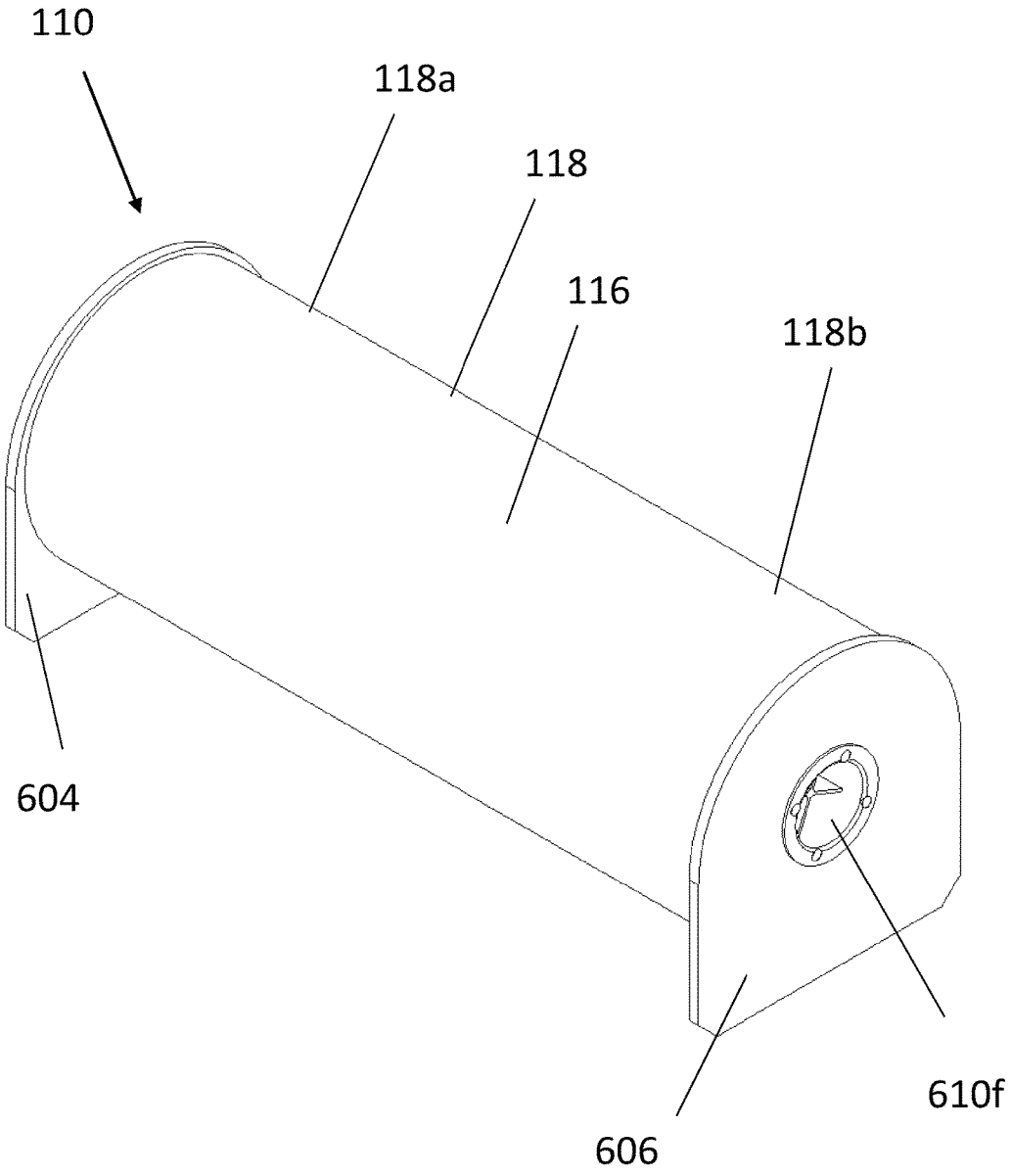
FIG. 4 is a front perspective view of an apparatus illustrating a replaceable cartridge of expandable sheet material.
Figure 5:
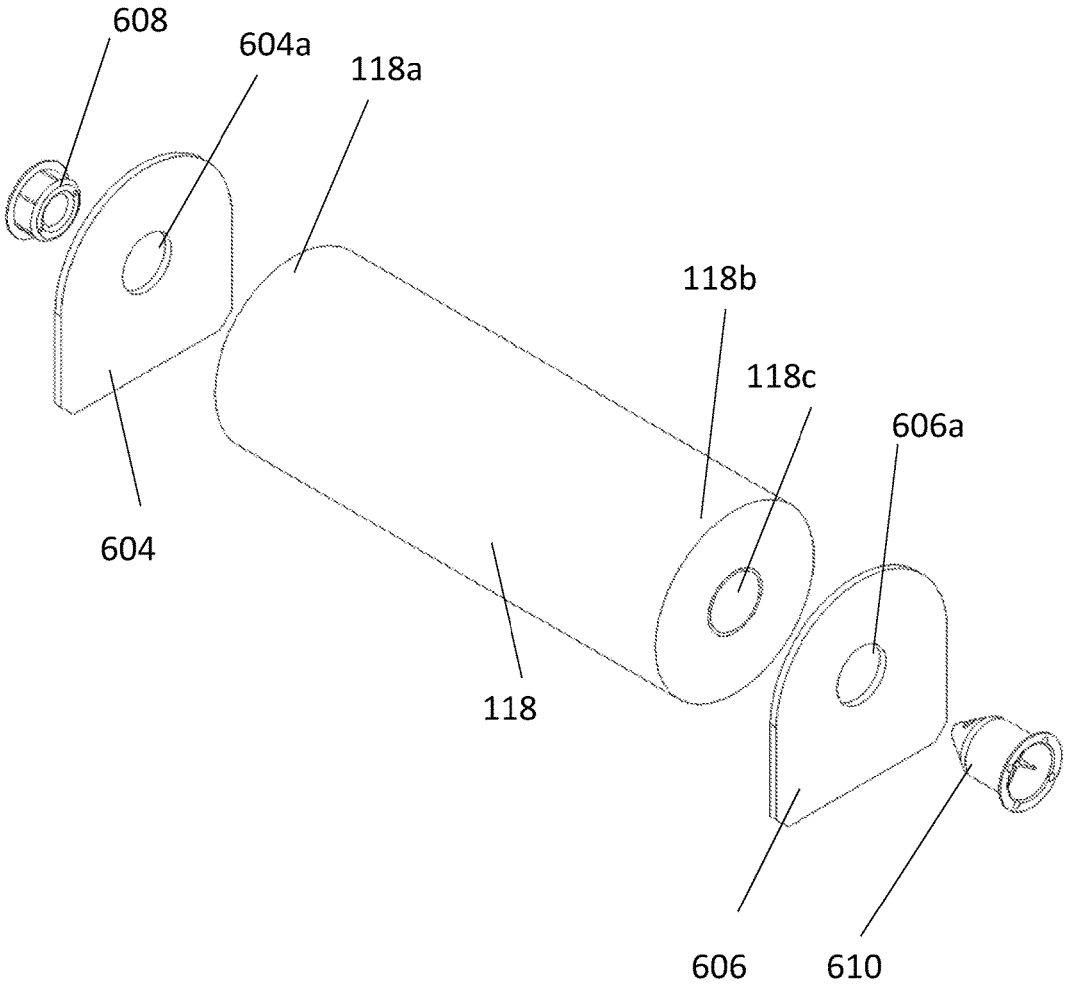
FIG. 5 is an exploded perspective view of the replaceable cartridge of FIG. 4.
Figure 6:
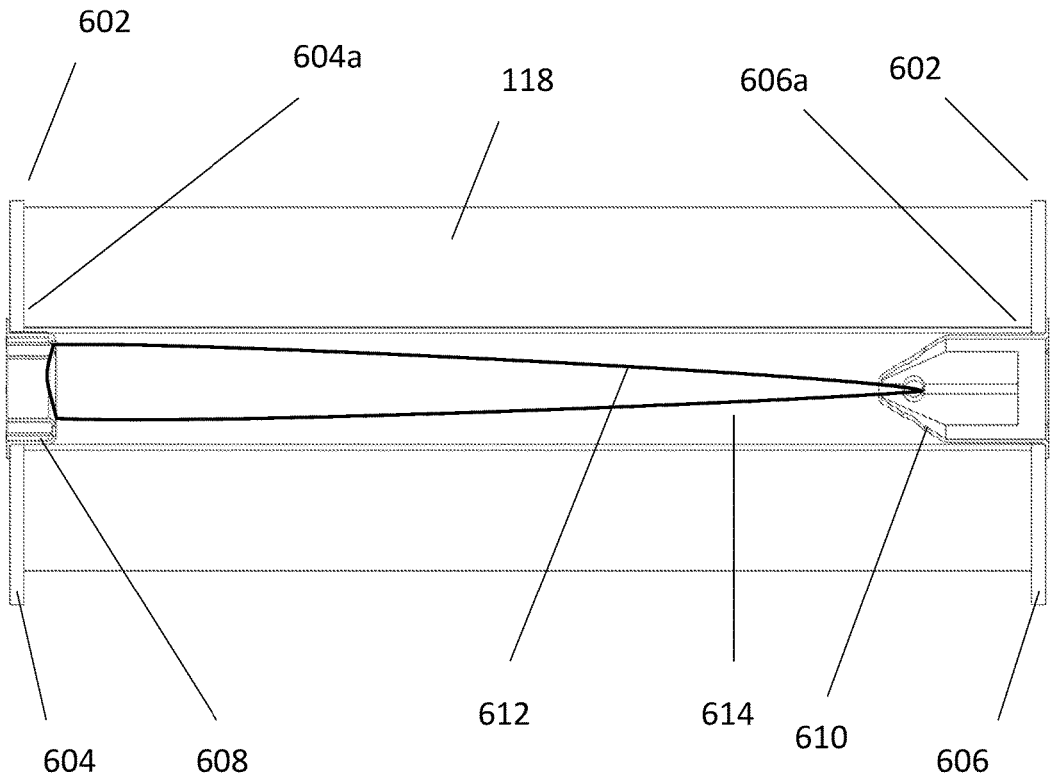
FIG. 6 is a front sectional view of an apparatus illustrating a tension assembly for adjusting rotational resistance of the replaceable cartridge of expandable material.
Figure 9:
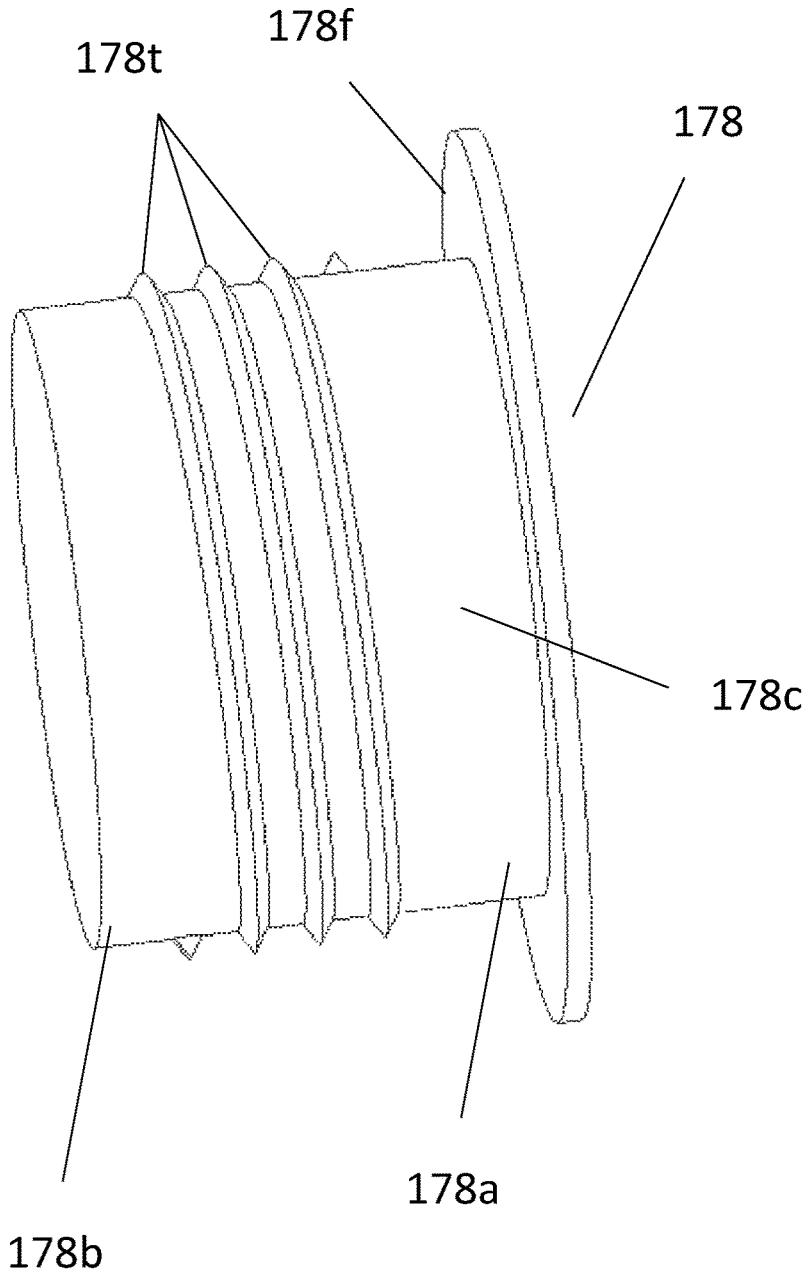
FIG. 9 is a perspective view of a threaded core plug that can be used in the replaceable cartridge of FIG. 4.

An exemplary tensioning assembly 602 is illustrated in FIGS. 4 and 9, and includes first and second end panel support members 604 and 606, first and second core plugs 608 and 610, and such as a flexible cord 612, connecting the core plugs 608 and 610. The first and second support members 604 and 606 each have an opening 604*a*, 606*a*. The first support member 604 is located proximate to a first end 118*a* of the roll 118 of expandable sheet material 116, and the second support member 606 is located proximate to an opposing second end 118*b* of the roll 118 of expandable material 116. The first and second support members 604 and 606 can be rigid or semi-rigid flat members such as cardboard members that abut respective axial ends of the roll 118 of expandable sheet material 116. When mounted in the frame 106 (FIG. 1), these support members 604 and 606 are received in or reside closely spaced in the slots formed by second pair of brackets 212.

Figure 8:
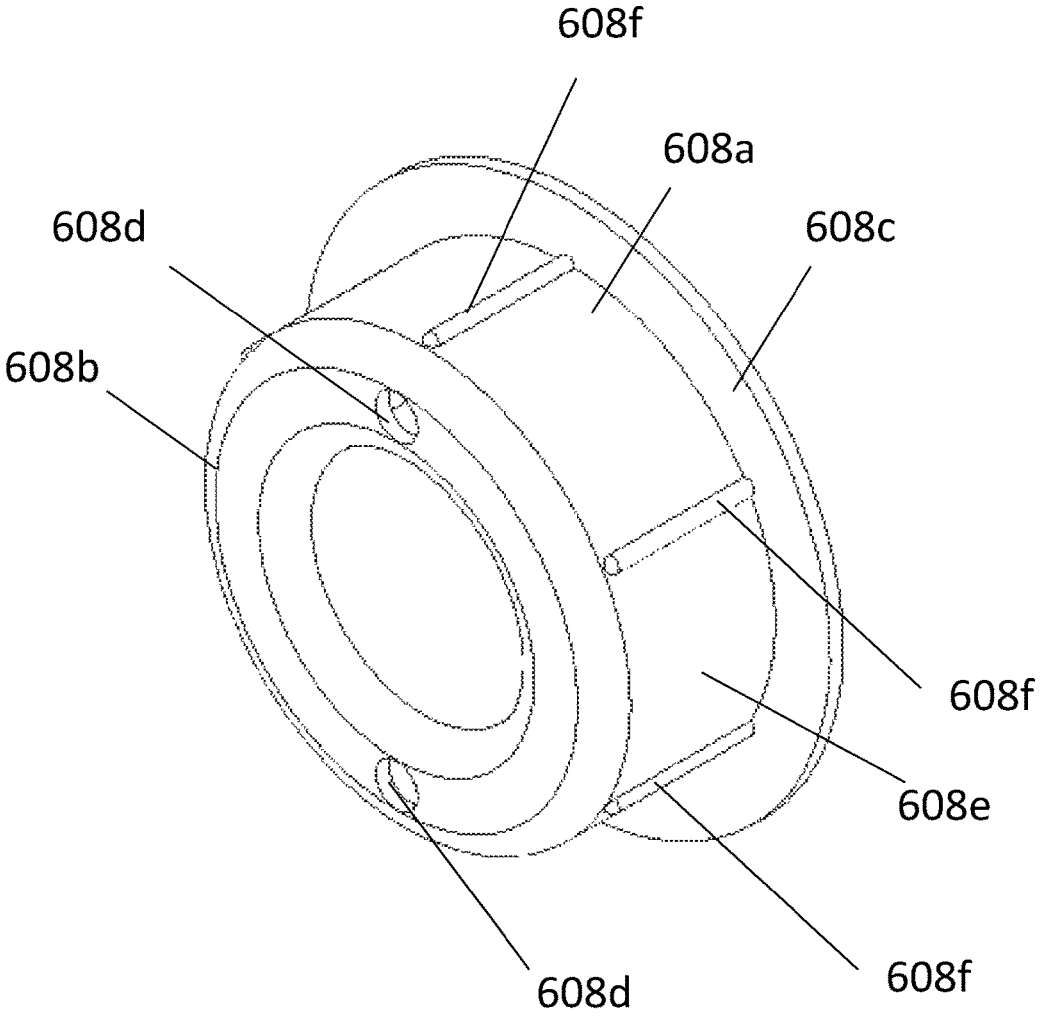
FIG. 8 Is a perspective view of a first core plug that can be used in the replaceable cartridge of FIG. 5.

The first core plug 608 includes opposite first and second end portions 608*a*, 608*b*, as illustrated in FIG. 8. A radially outwardly-directed flange 608*c* is positioned adjacent the first end portion 608*a*. First and second passageways 608*d* are formed through the first core plug 608 from the first end 608*a* to the second end 608*b*. The first core plug 608 includes a generally cylindrical intermediate portion 608*e* between the first and second end portions 608*a* and 608*b*. A plurality of circumferentially spaced-apart ribs 608*f* extend outwardly from the intermediate portion 608*e*, as illustrated in FIG. 8. The ribs 608*f* are configured to frictionally engage a portion of the hollow core 118*c* of the roll 118 when the first core plug 608 is inserted in the hollow core 118*c*.

Figure 7:
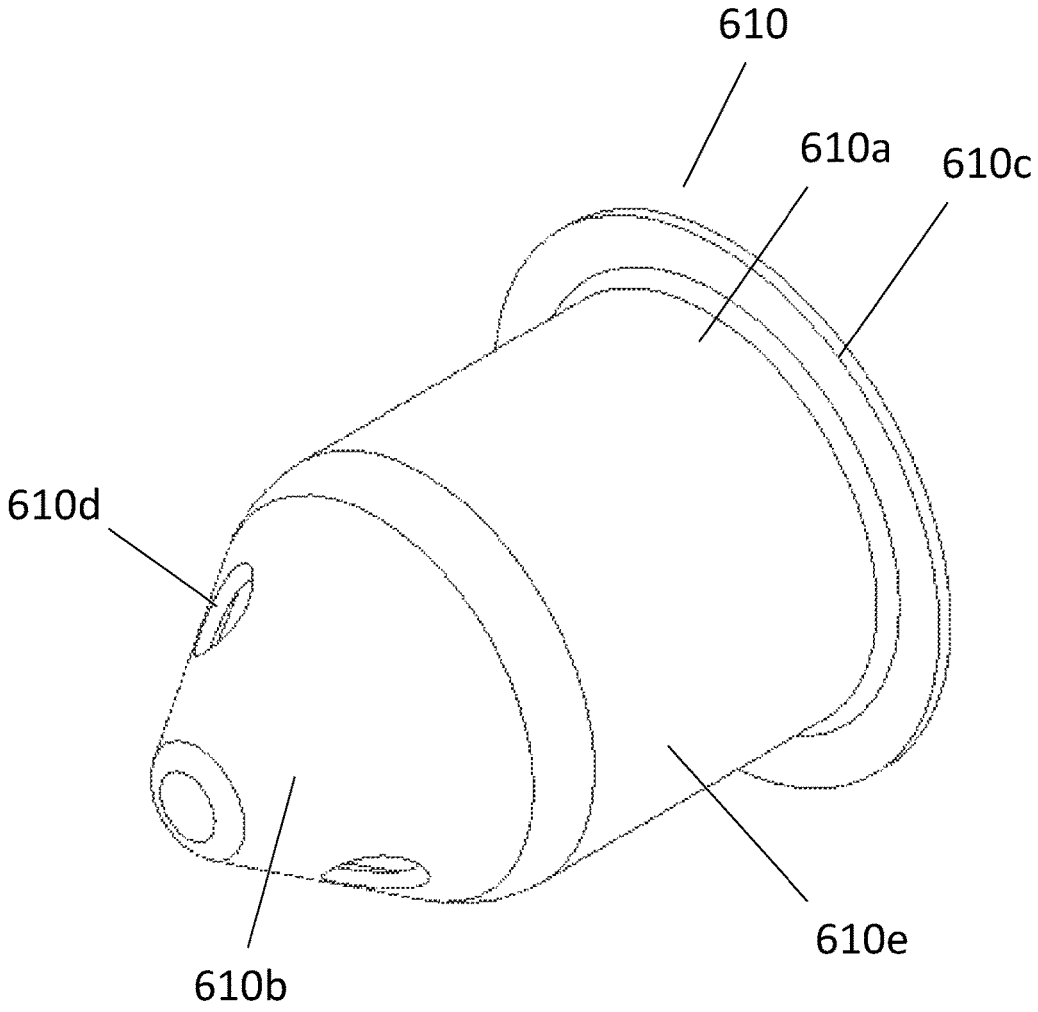
FIG. 7 Is a perspective view of a second core plug that can be used in the replaceable cartridge of FIG. 4.

The second core plug 610 includes opposite first and second end portions 610*a* and 610*b*, as illustrated in FIG. 7. A radially outwardly-directed flange 610*c* is positioned adjacent the first end portion 608*a*. A passageway 610*d* is formed through the second end portion 610*b*, as illustrated. The second core plug 610 includes a generally cylindrical intermediate portion 610*e* between the first and second end portions 610*a* and 610*b*. The second end portion 610*b* can taper to a relatively narrow end from the cylindrical portion 610*e*. Because the core plugs 608 and 610 cap the ends of the hollow core of the roll 118, the core plugs 608 and 610 also can be referred to as end caps.

Referring to FIGS. 1, 6, 7, and 8, the second end portion 608*b* of the first core plug 608 extends through the opening 604*a* in the first support member 604 and into one end of the hollow core 118*c* such that the first support member 604 is positioned between a first end 118*a* of the roll 118 of expandable sheet material 116 and the first core plug flange 608*c*. A washer (not shown) may be used, positioned between the first support member 604 and the first core plug flange 608*c*. The second end portion 610*b* of the second core plug 610 extends through the opening 606*a* in the second support member 606, and into an opposite end of the hollow core 118*c* such that the second support member 606 is positioned between an opposite second end 118*b* of the roll 118 of expandable sheet material 116 and second core plug 610 flange 610*c*. In place of or in addition to the flange 610*c*, a washer may be used, positioned between the second support member 606 and the second core plug flange 610*c*.

The cord 612, which may be a rope, string, wire, etc., extends though the hollow core 118*c* of the roll 118 of expandable material 114, through the two passageways 608*d* in the first core plug 608, and through the passageway 610*d* in the second core plug 610 to form a loop 614. The second core plug 610 is rotatable within the opening 606*a* in the second support member 606 and serves as an adjustment device for adjusting rotational resistance of the roll 118. The second core plug 610 includes an externally-accessible exposed end portion 610*f* (FIG. 4) that is configured to be gripped by a user such that the user can rotate the second core plug 610 relative to the hollow core 118*c* and the first core plug 608. Rotating the second core plug 610 relative to the first core plug 608 to cause the loop 614 to twist causes the first and second core plugs 608 and 610 to move relative to each other, specifically causing the first support member 604 to exert compressive force on the first end 118*a* of the roll 118 and the second support member 606 to exert a compressive force on the second end 118*b* of the roll 118. Continuous rotation of the second core plug 610 in either a clockwise or a counterclockwise direction will cause the first and second support members 604 and 606 to exert a larger or smaller compressive force on the first and second ends 118*a*, 118*b* of the roll 118 to increase or decrease rotational resistance. Rotation of the second core plug 610 that causes loop 618 to return to a neutral untwisted state will reduce the compressive force of the first and second support members 604 and 606 to decrease rotational resistance. In use, as the expandable sheet material 114 is drawn from the cartridge 110, the diameter of the roll 118 will decrease, which may require adjustment of the force applied to the ends of the roll 118 to maintain a relatively constant tension.

In alternative embodiments, the cord 612 may be replaced by a rod (not shown) that extends through the hollow core 118*c*. One end of the rod may be secured to the first core plug 608 and the opposite end may be threadingly secured to the second core plug 610. Rotation of the second core plug 610 may cause the first and second core plugs 608 and 610 to move towards each other, as described above. For example, clockwise rotation of the second core plug 610 may cause the first support member 604 to exert a compressive force on the first end 118*a* of the roll 118 and the second support member 606 to exert a compressive force on the second end 118*b* of the roll 118, thereby increasing rotational resistance of the roll 118. Similarly, counterclockwise rotation of the second core plug 610 may reduce the compressive force of the first and second support members 604, 606 to decrease rotational resistance. Accordingly, the tensioning assembly is adjustable to vary the pressure applied to the ends 118*a* and 118*b* of the roll 118 of expandable sheet material 116

As another alternative, the second core plug 610 and the cord 612 can be replaced by a threaded core plug 178 (FIG. 9) that is used to apply a compressive force on the second end 118*b* of the roll 118 of expandable sheet material 116. As illustrated in FIG. 9, the threaded core plug 178 includes opposite first and second end portions 178*a* and 178*b*, and a radially outwardly-directed flange 178*f* positioned adjacent the first end portion 178*a*. The threaded core plug 178 includes a generally cylindrical intermediate portion 178*c* between the first and second end portions 178*a*, 178*b*. Threads 178*t* on the intermediate portion 178*c* are configured to engage the hollow core 118*c* of the roll 118 and urge the roll 118 towards the second support member 606 to exert a compressive force on the second end of the roll 118 in response to user rotation of the threaded core plug 178. With the illustrated configuration of the threads 178*t*, clockwise rotation of the threaded core plug 178 will urge the roll 118 towards the second support member 606 to increase rotational resistance and counterclockwise rotation of the threaded core plug 178 will move the roll 118 away from the second support member 606 to decrease rotational resistance.

The first and second end panel support members 604 and 606 form laterally-spaced end panels on opposite axial ends 118*a* and 118*b* of the roll 118 of expandable sheet material 116. The support members 604 and 606 each have lower edge portions that project radially beyond the radius of the roll on each side of a plane that includes the axis of rotation of the roll 118. These lower edge portions or feet support the roll 118 for rotation about the axis of rotation. The slots in the frame 106 formed by the surfaces of the brackets 212 hold the support members 604 and 606 to prevent the roll 118 from being pulled in a downstream direction and to prevent the support members 604 and 606 from rotating, thereby preventing the roll 118 from tipping out of engagement with the brackets 212. The tensioning assembly 602 holds the support members 604 and 606 in abutment with respective ends of the roll. Specifically, the flange portions 608*c* and 610*c* of the first core plug 608 and the second core plug 610, respectively, form collars that bear directly against the side of the support members 604 and 606 opposite the adjacent roll 118 and the support members 604 and 606 directly engage respective ends of the roll 118.

In operation, as a user simultaneously manually pulls the interleaf material 112 and the expandable sheet material 116 from their respective rolls 112 and 118 while maintaining rotational resistance of the roll 118 of expandable sheet material 116 such that the expandable sheet material 118 expands to an expanded form in thickness and in length. The user then fills a void in a shipping container or wraps an article with the cushioning wrap material 108 formed by the combined interleaf material 112 and the expanded sheet material 114 so as to provide protection during packing and shipping.

The width of the material 116 in an expanded form 114 is less than a width of the unexpanded material, as illustrated in FIG. 1. To facilitate expansion of the material 114 to a proper expanded form, visual or physical guides (not shown in illustrations) may be provided to indicate the proper width of the material in an expanded form. The frame 106 also may include a cover that protects the rolls 112 and 118 and provides alternative surfaces for visual indicia, physical indicia, and arrangements for mounting brackets, support members, roll, rods and all other aforementioned parts.

In summary, the present invention provide an unpowered, manually operable apparatus 102 for dispensing cushioning wrap material drawn concurrently from a roll of separator material 112 and a self-contained cartridge 110 that includes a roll 118 of expandable sheet material 116. The rolls 112 and 118 are supported on a stand 106 for rotation about respective parallel, spaced-apart axes. In addition to the roll 118, the cartridge 110 includes a tensioning assembly 602 and support panels 604 and 606 that abut respective ends 118*a* and 118*b* of the roll 118. The tensioning assembly 602 and the support panels 604 and 606 cooperate with the stand 106 to control rotational resistance of the roll 118. The rotational resistance causes the expandable sheet material 116 to expand in length and thickness as it is manually pulled from the stand 106 with the separator material 112, and support surfaces on the stand 106 hold the cartridge 110 and the separator roll 112 in position. When the cartridge 110 containing the expandable sheet material 116 is depleted, the cartridge 110 is readily removed and replaced.

Although the invention has been shown and described with respect to a certain exemplary embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A self-contained material supply cartridge, comprising a roll of expandable sheet material having a slit pattern that forms an array of openings as the sheet material is drawn from the roll under tension;

a pair of laterally-spaced end panels between which the roll is mounted for rotation relative to the end panels about an axis of rotation for dispensing of the sheet material, the end panels having lower edge portions that project radially beyond the radius of the roll on each side of a plane that includes the axis of rotation, the end panels being configured to support the roll for rotation during the entire dispensing;

where the end panels are held in abutment with respective ends of the roll by a connector that extends between the end panels, the connector having a collar that bears directly against the side of the end panel opposite the roll, and the end panel directly engages the end of the roll;

where the connector is adjustable to vary pressure applied to the ends of the roll by the end panels; and where the roll includes a hollow core around which the expandable sheet material is wound and through which the connector is received, and the connector includes end caps received in respective ends of the hollow core and a flexible cord connects the end caps, whereby rotating one end cap relative to the other twists and shortens the flexible cord.

2. The cartridge as set forth in claim 1, where the roll is made of paper and the end panels are cardboard.

3. A stand for dispensing an expanded sheet material from a self-contained material supply cartridge having a roll of expandable sheet material that can be drawn from the roll in a downstream direction relative to the stand, the stand comprising a base member having first and second upwardly-opening slots laterally-spaced apart along a first axis and adapted to receive lower edge portions of support panels of a material supply cartridge, and third and fourth upwardly-opening slots laterally-spaced apart along a second axis spaced from and parallel to the first axis and adapted to receive an axle for a roll of separating sheet material, where the slots each have a transversely-extending surface on at least a downstream side of the slot to retain respective rolls as expandable sheet material and separating sheet material are concurrently drawn from the rolls.

4. The stand as set forth in claim 3, where base support member is generally planar and the slots are formed by first and second brackets mounted to the base support member, each bracket having an L-shape surface on a downstream side with a leg extending inwardly toward the opposing bracket.

5. The stand as set forth in claim 4, where each bracket has an L-shape surface on an upstream side opposite the downstream side with a leg extending inwardly toward the opposing bracket.

6. The stand as set forth in claim 5, where the upstream and downstream L-shape surfaces form respective portions of a continuous U-shape surface.

7. The stand as set forth in claim 3, where the third and fourth upwardly-opening slots are defined by respective brackets with upwardly-opening slots.

8. The stand as set forth in claim 3 in combination with a self-contained material supply cartridge that includes a roll of expandable sheet material, a pair of laterally-spaced end panels to which the roll is mounted between the end panels for rotation relative to the end panels about an axis of rotation, the end panels having lower edge portions that project radially beyond the radius of the roll on each side of a plane that includes the axis of rotation, where the end panels are held in abutment with respective ends of the roll by a connector that extends between the end panels, the connector having a collar that bears directly against the side of the end panel opposite the roll, and the end panel directly engages the end of the roll.

9. The combination as set forth in claim 8, in combination with a roll of separating sheet material made of paper mounted on an axle for receipt in the third and fourth slots.

* * * * *